US006702632B2

(12) United States Patent
Kameoka

(10) Patent No.: US 6,702,632 B2
(45) Date of Patent: Mar. 9, 2004

(54) LUBRICATION SYSTEM FOR OUTBOARD MOTOR SHAFT COUPLING

(75) Inventor: Kentaro Kameoka, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/186,271

(22) Filed: Jun. 27, 2002

(65) Prior Publication Data

US 2003/0073359 A1 Apr. 17, 2003

(30) Foreign Application Priority Data

Jun. 27, 2001 (JP) ..... 2001-193862

(51) Int. Cl.[7] ..... B63H 21/38

(52) U.S. Cl. ..... 440/88 L; 123/196 W; 440/83

(58) Field of Search ..... 440/900, 88 L, 440/83; 123/196 W

(56) References Cited

U.S. PATENT DOCUMENTS 2,440,338 A * 4/1948 Kincannon ..... 184/6.18
2,684,061 A * 7/1954 Kiekhaefer ..... 123/196 W
2,889,009 A * 6/1959 Endebak et al. ..... 184/55.2
3,577,746 A 5/1971 Dolan
3,589,471 A 6/1971 Edge
3,889,489 A 6/1975 Casey et al.
4,683,985 A 8/1987 Hultgren
4,771,864 A 9/1988 Lorimor et al.
4,904,214 A 2/1990 Eick
4,913,671 A 4/1990 Gavriles et al.
5,366,399 A 11/1994 Reid et al.
6,488,553 B2 * 12/2002 Bourret ..... 440/83

FOREIGN PATENT DOCUMENTS

JP 2001-303920 A * 10/2001

* cited by examiner

*Primary Examiner*—Sherman Basinger
(74) *Attorney, Agent, or Firm*—Knobbe, Martens, Olson & Bear, LLP

(57) ABSTRACT

A lubrication system is provided that allows delivery, and preferably regulated delivery, of lubricant to a coupling between a crankshaft and the driveshaft of, for example, an outboard motor. The lubrication system includes a passageway through which lubricant flows, and preferably a flow restrictor regulates the amount of lubricant delivered through the passageway. In one mode, the passageway is generally formed vertically through the central axis of a vertically oriented crankshaft and extends between the crankcase chamber and the coupling. Lubricant, such as crankcase oil, is able to flow through the passageway and onto the coupling. One or more seals preferably inhibit lubricant from flowing beyond the coupling.

19 Claims, 6 Drawing Sheets

LUBRICATION SYSTEM FOR OUTBOARD MOTOR SHAFT COUPLING

PRIORITY INFORMATION

This application is based on and claims priority to Japanese Patent Application No. 2001-193862, filed on Jun. 27, 2001, the entire contents of which is hereby expressly incorporated by reference.

BACKGROUND OF THE INVENTION

1. Field of the Invention

This invention relates to an engine for an outboard motor and more particularly to an improved lubrication system for an outboard motor.

2. Description of the Related Art

Outboard motors typically have an internal combustion engine that is coupled to a propulsion unit, such as a propeller, for propelling the boat through the water. The internal combustion engine includes one or more pistons reciprocally connected to a crankshaft for rotation during the combustion process. The crankshaft, in turn, is typically spline-coupled to a driveshaft that transmits the engine torque through a bevel-gear transmission and to a propeller shaft which carries the propeller. Thus, the engine output is transmitted from the crankshaft to the driveshaft and ultimately to the propeller.

The typical outboard motor utilizes a spline-coupling to connect the male driveshaft spline to the female crankshaft spline. In order to maintain a smooth engagement in the coupling, grease is typically packed into and around the coupling. The coupling is usually re-packed during routine maintenance, which requires the driveshaft to be uncoupled and removed from the crankshaft. Once grease is packed into the coupling, the driveshaft is reconnected to the crankshaft via the spline coupling. During normal use, however, the grease may lose its efficacy and may dry, thus leaving the coupling dry and unlubricated, which can damage the coupling, either because of burning and/or rusting.

SUMMARY OF THE INVENTION

An aspect of the present invention involves an outboard motor comprising an internal combustion engine having a lubrication system for lubricating a coupling between the engine's crankshaft and a driveshaft of the outboard motor. The engine includes a cylinder bore that defines in part a combustion chamber and a piston that is disposed within the cylinder bore and is connected to the crankshaft. The crankshaft is journaled for rotation at least partially within a crankcase. The driveshaft is coupled to the crankshaft through a spline coupling and is also operatively coupled to a propulsion device. The lubrication system comprises a passageway that extends through the crankshaft and communicates with the crankcase and with an area in which the spline coupling is disposed. Lubricant flows through the passageway from the crankcase to the spline coupling in order to lubricate the coupling.

In accordance with another aspect of the present invention, a lubrication system for a coupling between an engine output shaft and a driven shaft is provided. The engine includes a chamber in which at least a portion of the engine output shaft is disposed. The lubrication system comprises a passageway through the output shaft which communicates with the chamber of the engine and with an area in which the coupling is disposed. The passageway is arranged such that lubricant flows through the passageway from the chamber to the coupling.

An additional aspect of the present invention involves an outboard motor lubricant delivery system. The lubrication system comprises a passageway that has a first end in fluid communication with a chamber of an engine and a second end in fluid communication with an area to be lubricated. The chamber contains lubricant. The passageway is formed substantially along a longitudinal axis of a crankshaft of the engine. A metering device is provided between the chamber and the area to be lubricated to control the rate of lubricant delivery from the chamber to the area.

BRIEF DESCRIPTION OF THE DRAWINGS

These and other features, aspects and advantages of the present invention will now be described with reference to the drawings of preferred embodiments, which embodiments are intended to illustrate and not to limit the present invention. The drawings comprise six figures.

DETAILED DESCRIPTION OF THE PREFERRED EMBODIMENTS OF THE INVENTION

Figure 1:
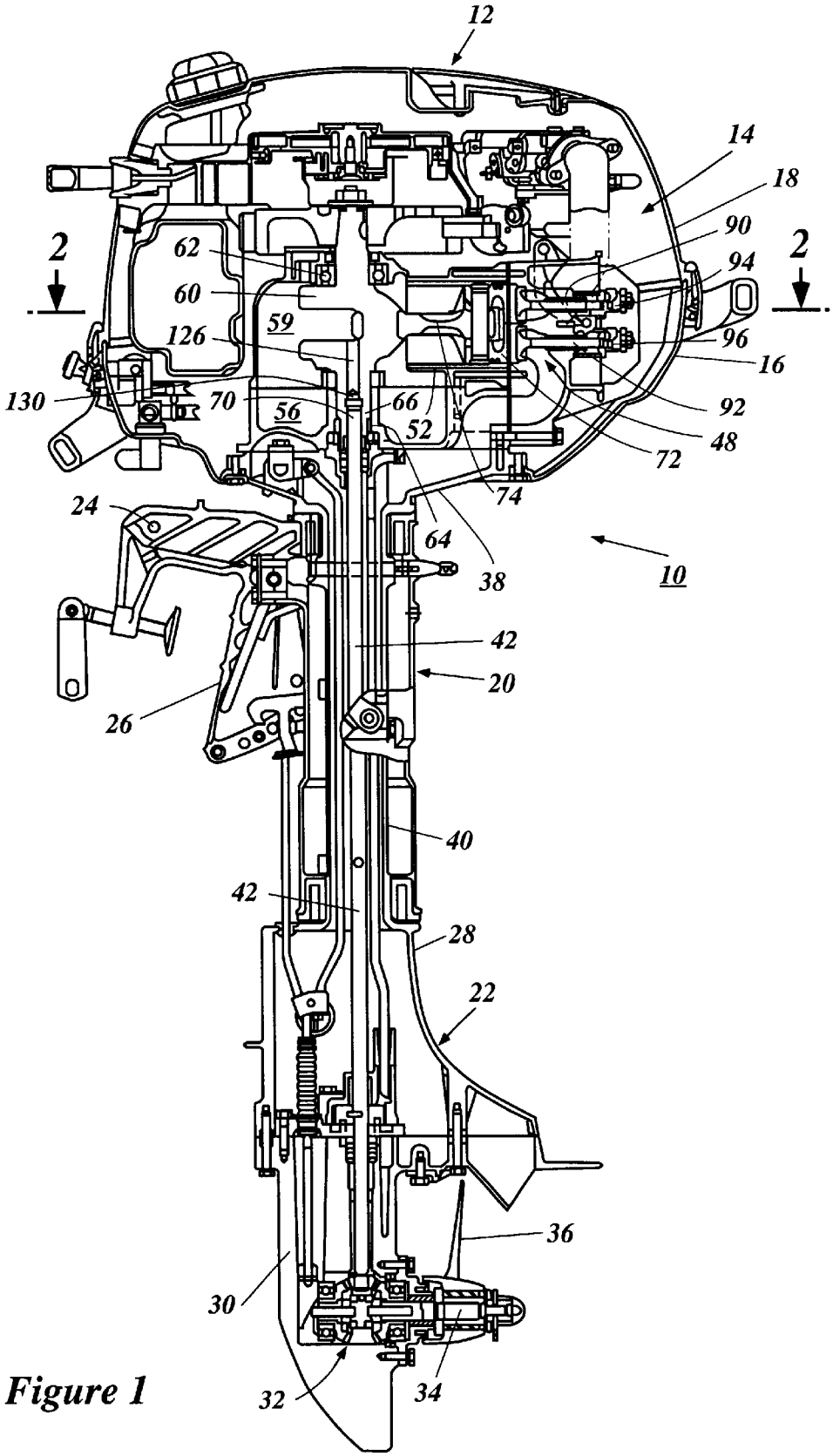
FIG. 1 a side sectional elevation view of an outboard motor including a lucubration system constructed in accordance with a preferred embodiment of the invention, showing certain components of the outboard motor broken away and in section.

With reference to the drawings and initially to FIG. 1, an outboard motor constructed in accordance with an embodiment of the invention is identified generally by the reference numeral 10.

The outboard motor 10 is comprised of a power head, indicated generally by the reference numeral 12, and a lower unit assembly, indicated generally by the reference numeral 22. The power head 12 includes an internal combustion engine 14, which is shown partially in cross-section in FIG. 1. While embodiments disclosed herein generally reference the use of a four-cycle internal combustion engine, it should be apparent to those of skill in the art that the lubrication system disclosed herein may also be used in engines operating on two-cycle combustion principles. The lubrication system can also be used with engine employed in other applications (e.g., lawn mowers) in which the engine is stood generally upright (i.e., the rotational axis of the engine is upright).

Figure 3:
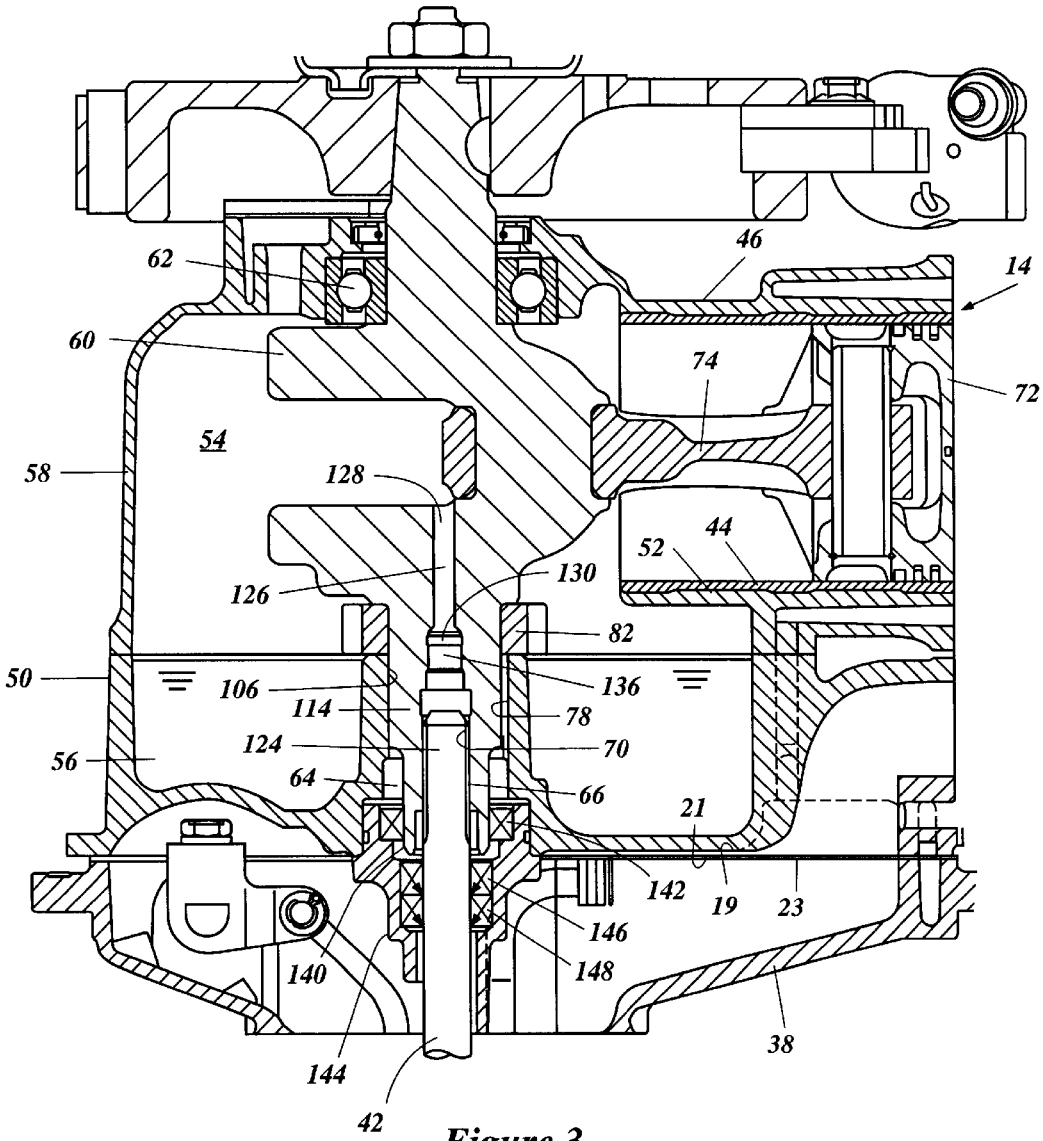
FIG. 3 is an enlarged side sectional view of the engine of FIG. 1 showing a crankcase chamber of the engine and a spline coupling between a crankshaft of the engine and a driveshaft of the outboard motor.

The power head 12 is covered primarily by a protective cowling that is comprised of a lower tray portion 16 and an upper main cowling portion 18. As best seen in FIG. 3, the power head 12 has a lower mating surface 19 configured to seal with an upper mating surface 21 of the lower unit assembly 22. A sealing member, such as a gasket 23, may be disposed between the lower mating surface 19 of the power head 12 and the upper mating surface 21 of the lower unit assembly 22.

As illustrated in FIG. 1, the lower unit assembly 22 depends vertically downward from the power head 12 and comprises components for transferring the output of the engine to a propeller 36. The lower unit assembly 22 includes a driveshaft housing 28 and lower unit housing 30 which may be a unitary construction, or may be separate components as illustrated, and may be formed from lightweight materials, such as an aluminum alloy or the like. The lower unit assembly 22 further includes an upper support plate portion 38 which is integrally connected to a generally tubular portion 40 that depends downwardly from the power head 12 to the lower unit housing 30. A driveshaft 42, which is driven by the engine 14, extends through the tubular portion 40 and has a bevel gear affixed to its lower end which forms a portion of a bevel gear reversing transmission 32.

The outboard motor 10 generates a propulsion thrust which is steerable by the inclusion of a swivel bracket, indicated generally by the reference numeral 20. This swivel bracket 20 is generally tubular and is affixed to a clamping bracket 26 by a pivot pin 24 for attachment of the outboard motor 10 to a boat transom. The pivot pin permits tilt and trim adjustment of the outboard motor 10 about the pivot pin 24. The swivel bracket 20 rotatably journals the driveshaft housing 28 for rotation about a generally vertical axis. Once the outboard motor 10 is attached to the boat transom by the clamping bracket 26, the swivel bracket 20 allows the outboard motor 10 to pivot about a vertically extending axis, and thus, direct the thrust for steering the boat.

With continued reference to FIG. 1, and additional reference to FIG. 3, the lower unit assembly 22 includes the driveshaft housing 28 to which is fixed the lower unit housing 30 that contains the bevel gear reversing transmission 32. The bevel gear transmission 32 can selectively coupled the driveshaft 42 to a propeller shaft 34 that is journaled in the lower unit housing 30. The control for this bevel gear transmission 32 may be any type of control as is generally known in the art.

The lower unit assembly 22 is operatively coupled to the power head 12 through a series of torque-transmitting couplings. The propeller 36 is carried by a propeller shaft 34 that is journaled for rotational movement. The propeller shaft 34 is coupled to the driveshaft 42 by a bevel gear transmission 32, as previously described. The driveshaft upper end 124 has a male spline coupling 70 that mates with a female spline coupling 66 of the crankshaft lower end 114 (collectively, the spline coupling). This spline coupling facilitates the power transfer from the engine crankshaft 60 to the driveshaft 42, and eventually, to the propeller 36.

The construction associated with the power head 12 will now be described by particular reference to FIGS. 1 through 3. The power head 12 houses an internal combustion engine 14 comprised of an engine body having three main portions: a cylinder block 46, a cylinder head 48, and a crankcase made up of a lower crankcase member 50 and an upper crankcase member 58. The lower crankcase member 50 and the upper crankcase member 58 join together to define a crankcase chamber 54. In the illustrated embodiment, the cylinder block 46 and the upper crankcase member 50 are formed as a unitary piece, but they need not be in other embodiments.

A crankshaft 60 is rotatably journaled within the crankcase chamber 54 by an upper main bearing 62 that is carried in cooperation by the cylinder block 46 and upper crankcase member 58. In addition, a lower main bearing 64 is cooperatively carried by the lower crankcase member 50 and journals the lower end of the crankshaft 60.

The cylinder block 46 defines, in the illustrated embodiment, a single horizontally extending cylinder bore 52. One end of the cylinder bore 52 is open to the crankcase chamber 54, while the other end is closed by the cylinder head 48. A piston 72 is supported for reciprocation within the cylinder bore 52. A sleeve or cylinder liner 44 fits within the cylinder bore 52 to define a cylinder. Rings on the piston 72 act against the cylinder liner 44 to generally seal the spaces on opposite sides of the piston 72 from each other (although some blow-by will occur). A connecting rod 74 connects the piston 72 to a throw of the crankshaft 60 upon which the connecting rod 74 is journaled in a well known manner. The illustrated embodiment shows only a single-cylinder, horizontal engine, but of course, various aspects and features of the lubrication system can be used with engines of various sizes, including a plurality of pistons in various orientations.

The cylinder head is formed with a recess proximate the cylinder bore 52 that defines, in part, the combustion chamber 76 of the engine 14. One or more intake ports and one or more exhaust ports are located at the recess to provide for the ingress of air and the egress of exhaust gases from the combustion chamber 76. The combustion chamber 76 is further defined by the cylinder and the piston 72. The combustion chamber 76 thus has a variable volume as the piston 72 reciprocates within the cylinder.

Air is delivered to the combustion chamber by an induction system through one or more intake ports, as is generally known in the art. Fuel can be either directly or indirectly delivered to the combustion chamber. In the illustrated embodiment, a carburetor forms the fuel-air charge which is delivered to the combustion chamber through an intake port; however other types of charge formers, such as, for example, fuel injection systems, can also be used.

Once the fuel-air charge is delivered to the combustion chamber, a spark plug 68 creates a spark across a spark gap 69, thus igniting the charge to cause combustion within the combustion chamber 76. The combustion increases the pressure within the combustion chamber 76 which causes the piston 72 to move away from the cylinder head 48. The piston 72 is rotatably connected to a crank pin of the crankshaft 60 through a connecting rod 74 and rotates the crankshaft 60 as moves. The momentum of the crankshaft 60 causes the piston to reciprocate in the cylinder between combustions, as well known in the art.

Figure 2:
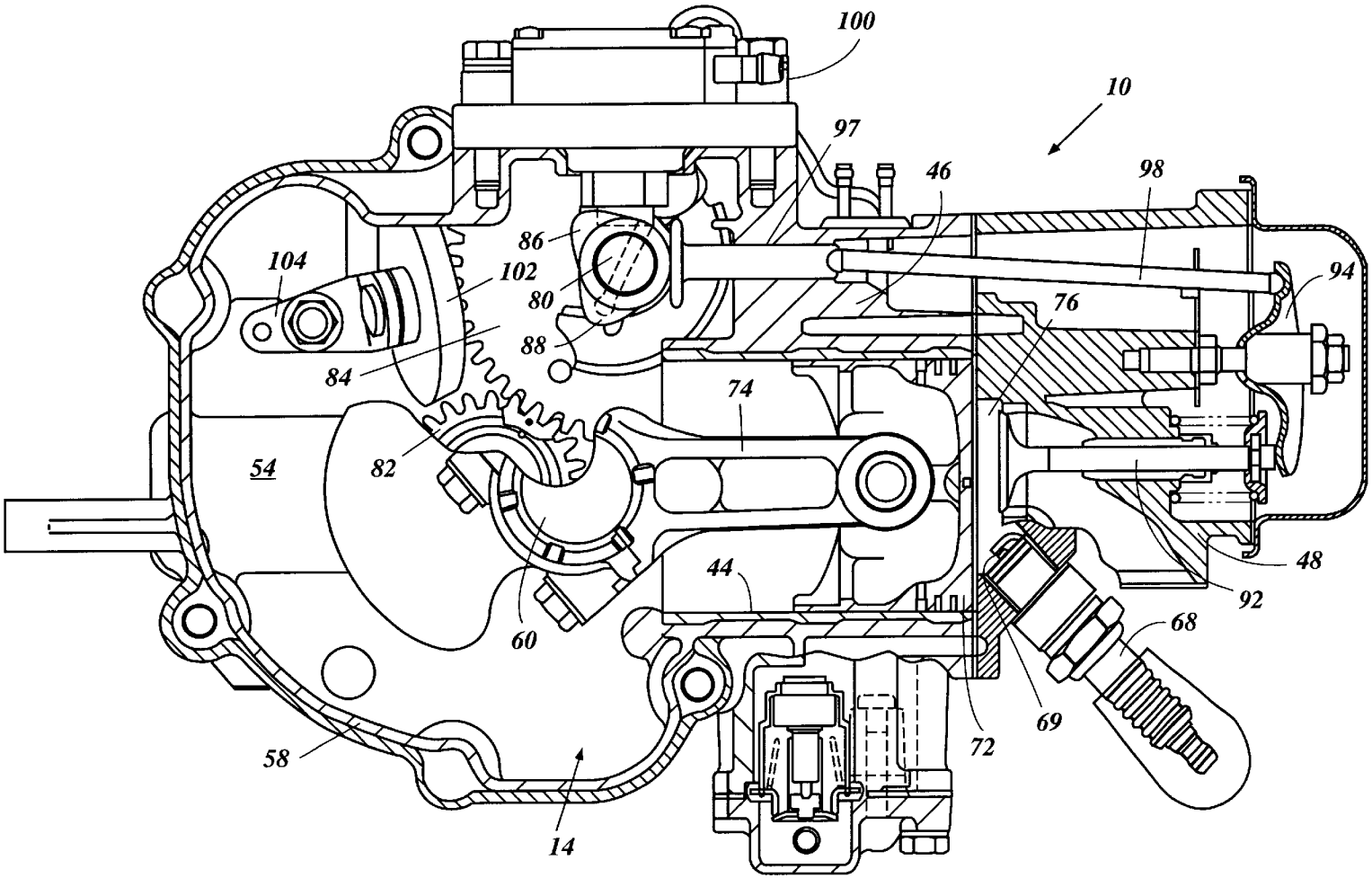
FIG. 2 is a cross-sectional view of an engine of the outboard motor taken along the plane 2—2 of FIG. 1.

The valve operating and lubricating system will now briefly be described by primary reference to FIGS. 1–3. A camshaft 80 is rotatably journaled within the crankcase chamber 54 by suitable bearings formed at its opposite ends. The camshaft 80 is driven at a reduced speed in comparison to that of the crankshaft 60 by a timing mechanism comprising a drive gear 82 that is fixed for rotation with the crankshaft 60 and a driven gear 84 that is fixed for rotation with the camshaft 80.

In the illustrated embodiment, the camshaft 80 is provided with a pair of cam lobes 86, 88 for operating an intake valve and an exhaust valve 92, respectively, through their respective rocker arms 94. The intake valve is disposed at the intake port on the cylinder head and regulates air flow through the intake port. Similarly, the exhaust valve 92 is disposed at the exhaust port on the cylinder head and regulates gas flow through the exhaust port.

A pair of tappets 97 are slidably supported within the cylinder block 46 and follow the cam profile and displace linearly in response to the cam lobes 86, 88. The linear motion of the tappets 97 is communicated through respective push rods 98 to actuate the rocker arms 94. Each push rod 98 is associated with a respective one of the rocker arms 94 for operating it in a manner well known in the art. Notably, the fuel pump 100 may be driven off of an additional lobe on the camshaft 80. The camshaft 80 therefore drives both the intake valve 90 and exhaust valve 92 in a well-known manner.

After combustion, the exhaust gases are expelled out the exhaust port (with the exhaust valve 92 opened) and through the remainder of the exhaust system to the atmosphere. In the illustrated embodiment, a portion of the exhaust system is formed by the cylinder block 46 and by a portion of the upper support plate portion 38 of the lower unit assembly 22, as best seen in FIG. 3.

The motion of the power head components such as the piston 72, connecting rod 74, crankshaft 60, camshaft 80, tappets 96, and valves 90, 92 require a lubricant in order to overcome frictional resistance, thereby maintaining engine efficiency and power output. To this end, small internal combustion engines may rely on an lubricant slinger gear indicated by the reference numeral 102 (FIG. 2), which is mounted for rotation proximate to the lubricant level in the lubricant reservoir 56 on a mounting bracket 104. The lubricant slinger gear 102 meshes with the driven gear 84 and rotates about an axis transverse to the driven gear axis. The lubricant slinger gear is in fluid contact with lubricant in the lubricant reservoir 56 such that as the lubricant slinger gear 102 rotates, the gear 102 throws lubricant around the crankcase chamber 54 such that it contacts the crankshaft 60, camshaft 80, and other moving components. With respect to lubricating the crankshaft 60, the lower crankcase member 50 defines a crankshaft lubrication groove 78 that allows the lubricant to flow therethrough to coat the surface of the crankshaft 60 at this location.

Figure 4:
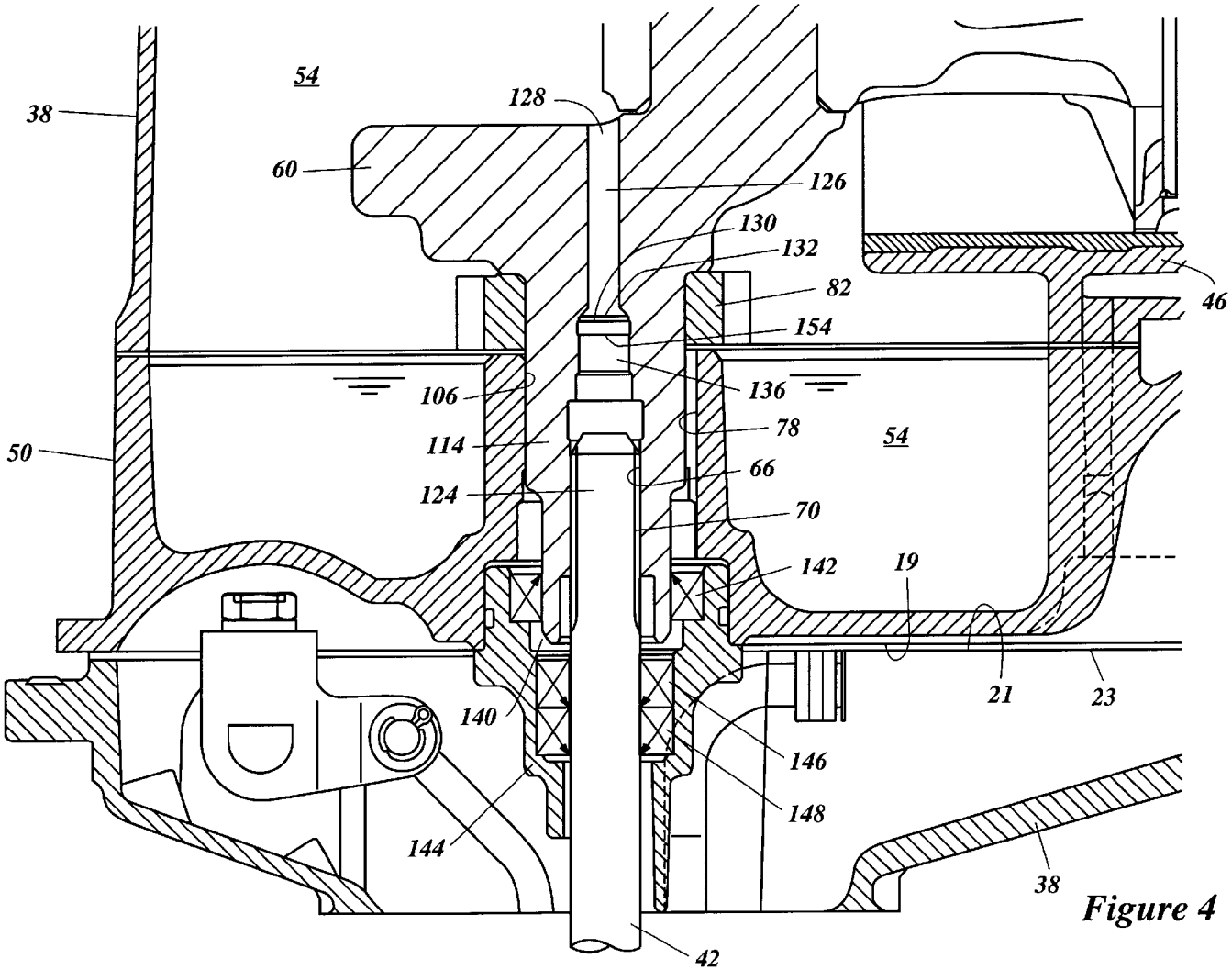
FIG. 4 is an enlarged view of the coupling and the surrounding engine components shown in FIG. 3.

With reference to FIGS. 3 and 4, the arrangement of the crankshaft 60, driveshaft 42, and their interconnection is illustrated. The crankshaft 60 is journaled for rotation as has been previously described and has a lower end 114 that forms the female spline coupling 66. The female spline coupling 66 receives the male spline coupling 70 on the driveshaft upper end 124. As previously described, this coupling is generally packed with grease to maintain adequate lubrication for the interface of the two components. However, during normal use, the grease may dry out, thus leaving the coupling unprotected. To overcome this, a lubricant passageway 126 is provided to deliver crankcase lubricant to the coupling. The lubricant passageway 126 has an upper end opening 128 in communication with the crankcase chamber 54 and a lower end in communication with a space 136 above the spline coupling. Therefore, as the slinger gear 102 splashes lubricant around the crankcase chamber 54, some lubricant will be deposited within or flow into the lubricant passageway 126. The lubricant passageway 126 preferably is formed along the axial center of the crankshaft 60 and its opening 128 opens into a space formed between the throws of the crankshaft 60 and adjacent to the crank pin. The lubricant passageway 126, however, can have other configurations and the opening 128 can be located elsewhere on the crankshaft 60. The lubricant passageway preferably has a cross-sectional diameter smaller than a cross-sectional diameter of the male spline coupling 70 at the upper end of the driveshaft 42.

In some embodiments, the lubricant is free to flow through the lubricant passageway 126 and directly to the spline coupling; however, in other embodiments it may be preferable to regulate the amount of lubricant delivered to the spline coupling.

Ways of regulating the delivery of lubricant include restricting the diameter of the upper end opening 128, varying the size of the lubricant passageway 126, or incorporating a flow restrictor. The illustrated embodiment utilizes a lubricant flow restrictor 130 disposed at the end of the lubricant passageway 126; however, it could be disposed at other locations, for example, within the passageway 126. In the illustrated embodiment, the lubricant flow restrictor 130 comprises a porous bronze alloy sintering plug; however, the plug can be made of other materials through which lubricant can drip as well, such as, for example, a synthetic resin. The lubricant flow restrictor 130 can be other types of devices as well that restrict the flow of lubricant to the spline coupling. Such devices include, without limitation, a valve, capillary tube(s), aperture(s), and the like.

The lubricant flow restrictor 130 illustrated in FIGS. 3 and 4 is disposed just below the passageway 126 and has a sufficient porosity to permit the lubricant to drip onto the spline coupling. A column of lubricant tends to collect within the passageway 126 above the top surface 132 of the lubricant flow restrictor 130. The head (pressure) caused by this lubricant column causes the lubricant to drip from a lower surface 134 of the flow restrictor 130 onto the spline coupling. The fluid pressure and permeable flow restrictor 130 thus cooperate to deliver lubricant to the spline coupling in a generally controlled manner.

The lower surface 134 of the lubricant flow restrictor 130 is exposed to the open space 136 and the spline coupling. The lubricant will wet both the male spline coupling 70 and the female spline coupling 66 to provide sufficient lubrication. No grease needs to be added. The lubricant will tend to flow downwardly and fill a lubricant collection space 140 that is preferably located below the spline coupling. To ensure a fluid-tight seal around the spline coupling, a first lubricant seal 142 is carried by a seal housing 144 and is disposed above the lubricant collection space 140. The seal housing 144 further carries a second and third lubricant seal 146, 148 to inhibit any lubricant from flowing down the driveshaft 42 and into the lower unit assembly 22. These additional seals 146, 148 are disposed below the lubricant collection space 140.

Figure 5:
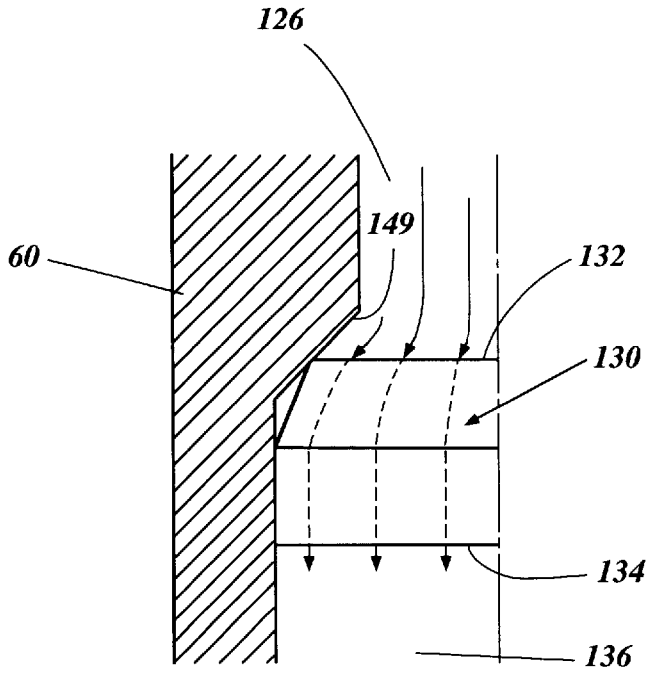
FIG. 5 illustrates a lubricant passageway through the crankshaft with a lubricant flow regulating insert.

FIG. 5 shows an enlarged view of the lubricant flow restrictor 130 in which the restrictor 130 is press-fit into the space 136 just below a lower end of the lubricant passageway 126. The intersection between the lubricant passageway 126 and the space 136 is configured with a sloped sidewall 149 for, among other things, directing the lubricant to contact the entire upper surface 132 of the flow regulator 130.

Figure 6:
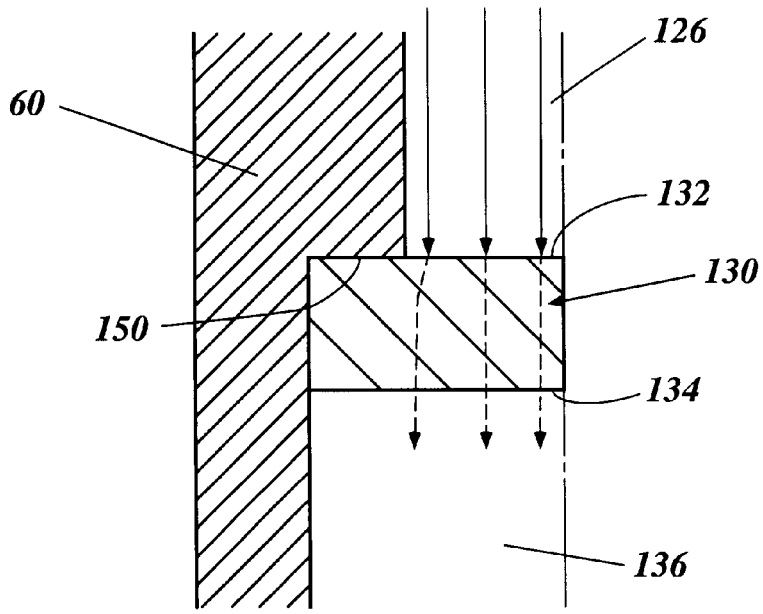
FIG. 6 is an another lubricant passageway through the crankshaft with a lubricant flow regulating insert in accordance with another preferred embodiment of the present invention.
Figure 1:
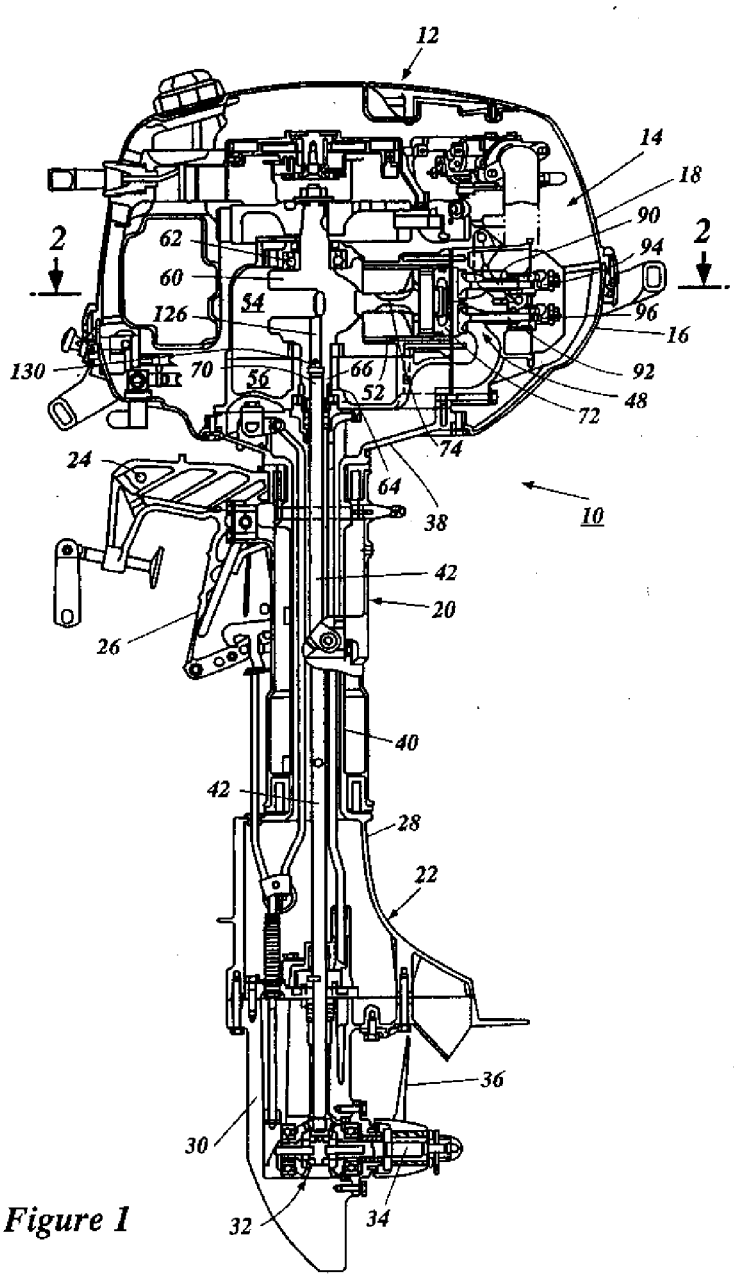

FIG. 6 illustrates another embodiment of the lubricant flow restrictor 130 and the lubricant passageway 126 wherein a shoulder 150 is formed at the intersection between the lubricant passageway 126 and the lower space 136. A portion of the top surface 132 of the flow regulator 130 abuts the shoulder 150. The shoulder 150 provides a positive stop for positioning the flow regulator 130 during insertion into the space 136. While this illustrated embodiment reduces the effective surface area of the top surface 132 through which lubricant flows, it can be compensated by varying the characteristics of the flow regulator 130. FIGS. 5 and 6 both illustrate a flow regulator 130 that is frictionally mounted in place within the space 136; however, other mounting devices and methods are possible.

Thus, a lubrication system delivers sufficient lubricant from the crankcase chamber to the spline coupling between the crankshaft 60 and driveshaft 42. Accordingly, the driveshaft 42 need not be removed for maintenance purposes in order to repack the spline coupling with grease. In some applications, the spline coupling need not receive grease even when originally assembled. The lubricant system preferably includes the flow restrictor 130 to generally regulate the amount of lubricant delivered to the spline coupling.

While the foregoing description has been limited to specific preferred embodiments, it should be appreciated that variations therefrom are anticipated without departing from the full spirit and scope of the present invention. Thus, while the invention has been described herein with reference to certain preferred embodiments, these embodiments have been presented by way of example only, and not to limit the scope of the invention. Other embodiments and changes in form and detail may be made therein by one skilled in the art without departing from the spirit and scope of the invention, including embodiments which do not provide all of the benefits and features set forth herein. Accordingly, the scope of the present invention is intended to be defined only by the claims that follow.

What is claimed is:

1. An outboard motor comprising an internal combustion engine having a cylinder bore defining, in part, a combustion chamber, and further having a piston disposed within the cylinder bore and reciprocally connected to a crankshaft journaled for rotation at least partially within a crankcase, a driveshaft coupled to the crankshaft through a spline coupling, a propulsion device operatively coupled to a the driveshaft, and a lubrication system comprising a passageway through the crankshaft in fluid communication with the crankcase and in further fluid communication with an area in which the spline coupling is disposed, a flow restrictor arranged within the passageway, the flow restrictor having sufficient porosity to regulate lubricant flow through the passageway to the area in which the spline coupling is disposed, whereby lubricant flows through the passageway from the crankcase to the spline coupling.

2. The outboard motor of claim 1, wherein the passageway has a sufficient length to collect lubricant above the flow restrictor.

3. The outboard motor of claim 1, wherein the passageway extends generally along a longitudinal axis of the crankshaft.

4. The outboard motor of claim 1, wherein the passageway opens into the crankcase chamber at a location between a pair of throws of the crankshaft.

5. The outboard motor of claim 1, wherein the passageway is substantially vertical and the lubricant is gravity fed through the passageway.

6. The outboard motor of claim 1 additionally comprising a lubricant collection area disposed below the spline coupling.

7. The outboard motor of claim 6, additionally comprising first and second seals, the first seal being disposed above the lubricant collection area and the second seal being disposed below the lubricant collection area.

8. The outboard motor of claim 1, wherein the passageway has a smaller cross-section than the cross-section of a splined upper end of the driveshaft.

9. A lubrication system for a coupling between an engine output shaft and a driven shaft, the engine including a chamber in which at least a portion of the engine output shaft is disposed, the lubrication system comprising a passageway through the output shaft which communicates with the chamber of the engine and with an area in which the coupling is disposed, the passageway being arranged such that lubricant flows through the passageway from the chamber to the coupling, and a flow regulator disposed within the passageway, the flow regulator having sufficient porosity to regulate lubricant flow through the passageway.

10. The lubrication system of claim 9 additionally comprising a lubricant flow restrictor disposed between the chamber and the driven shaft, whereby lubricant being supplied to the coupling passes through the lubricant flow restrictor.

11. The lubrication system of claim 10, wherein the output shaft is disposed substantially vertically.

12. The lubrication system as set forth in claim 9, wherein the passageway is provided along a longitudinal axis of the output shaft.

13. The lubrication system of claim 9, wherein the passageway extends into a bore formed at an end of the output shaft in which a plurality of female splines are formed.

14. An outboard motor comprising an internal combustion engine having a cylinder bore defining, in part, a combustion chamber, and further having a piston disposed within the cylinder bore and reciprocally connected to a crankshaft journaled for rotation at least partially within a crankcase, a drive shaft coupled to the crankshaft through a connection, a propulsion device operatively coupled to a the drive shaft, and a lubrication system comprising means for delivering lubricant from the crankcase to the connection and means for regulating the delivery of the lubricant to the connection.

15. An outboard motor lubricant delivery system comprising:

a passageway having a first end in fluid communication with a chamber of an engine, the chamber containing lubricant, and having a second end in fluid communication with an area to be lubricated, the passageway being formed substantially along the longitudinal axis of a crankshaft of the engine; and a metering device for controlling the rate of lubricant delivery from the chamber to the area to be lubricated.

16. The lubricant delivery system of claim 15, wherein the metering device is generally disposed within the passageway.

17. The lubricant delivery system of claim 15, wherein the metering device is disposed downstream within the passageway such that the porous member and passageway define a reservoir for storing and dispensing a volume of lubricant.

18. An outboard motor lubricant delivery system comprising:

a passageway having a first end in fluid communication with a chamber of an engine, the chamber containing lubricant, and having a second end in fluid communication with an area to be lubricated, the passageway being formed substantially along the longitudinal axis of a crankshaft of the engine; and a porous metering device for controlling the rate of lubricant delivery from the chamber to the area to be lubricated.

19. The lubricant delivery system of claim 18, wherein the metering device is disposed downstream within the passageway such that the porous member and passageway define a reservoir for storing a volume of lubricant.

* * * * *

UNITED STATES PATENT AND TRADEMARK OFFICE

CERTIFICATE OF CORRECTION

PATENT NO. : 6,702,632 B2
DATED : March 9, 2004
INVENTOR(S) : Kentaro Kameoka

It is certified that error appears in the above-identified patent and that said Letters Patent is hereby corrected as shown below:

Drawings,
Replace Fig. 1, Sheet 1 of 6, with the corrected attached new Fig. 1.

Signed and Sealed this

Twenty-third Day of November, 2004

JON W. DUDAS
*Director of the United States Patent and Trademark Office*